US005222704A

United States Patent [19]

Light

[11] Patent Number: 5,222,704

[45] Date of Patent: Jun. 29, 1993

[54] BAG SUPPORT DEVICE FOR SUPPORTING A BAG WITHIN A TRASH CONTAINER

[76] Inventor: Donald F. Light, #100 Bayview Dr., #2116, North Miami Beach, Fla. 33160

[21] Appl. No.: 895,983

[22] Filed: Jun. 3, 1992

[51] Int. Cl.[5] ..... B65B 67/04

[52] U.S. Cl. ..... 248/100; 220/404; 220/908; 248/97

[58] Field of Search ..... 248/100, 101, 95, 97, 248/99; 220/404, 908; 141/391, 314

[56] References Cited

U.S. PATENT DOCUMENTS

| | | | |
|---|---|---|---|
| 3,796,402 | 3/1974 | Trotta | 248/97 |
| 4,664,347 | 5/1987 | Brown | 220/908 X |
| 4,735,340 | 4/1988 | Preston | 220/404 |
| 4,763,808 | 8/1988 | Guhl | 220/908 X |
| 4,934,637 | 6/1990 | Guerrera | 248/100 |
| 4,946,065 | 8/1990 | Goulter | 220/908 X |

*Primary Examiner*—J. Franklin Foss
*Attorney, Agent, or Firm*—Malloy & Malloy

[57] ABSTRACT

A bag support device for supporting a plastic bag within a trash container, the device including a pair of elongate clamp arms structured and disposed to apply a clamping force on opposite sides of a wall of the container, and a hook member extending upwardly from a lower end of one of the clamp arms within the container, the hook member being structured and disposed to support a portion of a handle of a plastic bag placed within the container, wherein at least two of the support devices attached to opposite side walls of the container support opposite handles of the bag such that an open end thereof is held open such that items may be deposited therein.

1 Claim, 1 Drawing Sheet

BAG SUPPORT DEVICE FOR SUPPORTING A BAG WITHIN A TRASH CONTAINER

BACKGROUND OF THE INVENTION

1. Field of the Invention

The present invention is directed to a bag support device adapted to be attached to the side walls of a trash container for supporting the handles of a plastic bag placed within a container such that the bag is held open to facilitate depositing items therein.

2. Description of the Related Art

As an alternative to the traditional paper bags which have been used to pack groceries, many commercial stores are now using plastic bags which are generally provided with two handles formed therein so that the bag can be grasped and carried after various grocery items have been placed therein. Plastic bags not only offer the convenience of handles for carrying, but they are generally stronger, more durable, and cheaper than paper bags.

However, recent environmental concerns have created a heightened awareness of the problems associated with disposing of non-biodegradable articles, such as plastic. In an effort to reduce the amount of non-biodegradable materials being placed in landfills, many communities have implemented recycling programs, urging people to recycle various non-biodegradable materials. While recycling programs have been effective in reducing the overall amount of non-biodegradable materials placed in landfills, many items, such as plastic grocery bags, are still not suited for current recycling facilities.

In an effort to minimize damage to the environment caused by non-recyclable plastic grocery bags, consumers are urged to reuse the plastic bags once having removed their grocery items therefrom. One such use is a liner in a trash container which will eliminate the need for the consumer to use additional plastic bags for that purpose. The cost effectiveness of reusing plastic grocery bags as trash container liners, coupled with the environmental benefits, has lead to the development of various support means for supporting plastic grocery bags within trash containers. Many of these support means are integrally molded with the trash container during manufacture, such as those disclosed in the U.S. patents to Isgar, et al., U.S. Pat. No. 4,558,800, Brown, et al., U.S. Pat. No. 4,664,347, and Isgar, et al., U.S. Pat. No. 4,576,310. While these various trash containers are generally suited to support a plastic grocery bag in a functional position within the trash container, the need to purchase an entirely new trash container to replace one's existing trash container discourages many consumers from carrying out the main objective, which is to reuse plastic grocery bags as trash container liners.

Other plastic bag support devices which have been developed in the related art include those disclosed in the patents to Kloberg, Jr., U.S. Pat. No. Des. 301,102 and McCoyg, U.S. Pat. No. 4,925,056. The devices disclosed in these patents are adapted for attachment to existing trash containers, however, they are structured so as to extend upwardly from a rim of the container which would result in interference with a lid which many trash containers have to contain foul odors therein. Additionally, these devices are not universal in nature, but rather they are specifically designed for attachment to a particular size container. For instance, the device disclosed in U.S. Pat. Des. 301,102, is specifically designed to attach to opposite handles of a particular trash container and is not generally suited for attachment with a variety of conventional trash containers. The device in McCoyg, U.S. Pat. No. 4,925,056 includes clamp means which facilitates clamping of the device to various trash containers, however, the clamp means is not designed to accommodate for various widths in both the wall structure of the trash container of a bordering about an opening thereof.

The U S. patent to Burrows, U.S. Pat. No. 4,923,087 discloses a hook device which is structured to be fixedly attached on an exterior side wall of a trash container for supporting the handle of a bag thereon. While the device in Burrows could be used in connection with an existing trash container, the attachment requires a significant amount of labor, and once attached, the device is not intended to be removed therefrom. Another problem associated with the device in Burrows results from the attachment of the plastic bag handles on the exterior of the container which is unsightly and generally undesirous from an aesthetic perspective.

Accordingly, in view of the devices which have been developed in the related art, there still exists a need for a bag support device which is easily and removably attachable to an existing trash container wherein a number of the devices, attached to opposite side walls of the container, will support the handles of a plastic bag so as to hold the bag open within the trash container without interfering with various structure on the container.

SUMMARY OF THE INVENTION

The present invention is directed to a device for supporting a bag within a trash container and including clamp means for removable attachment thereof to the side walls of the trash container such that a hook member is disposed within the container for supporting a handle of the bag thereon. The clamp means includes a pair of elongate clamp arms which extend downwardly on opposite sides of a wall of the trash container, the arms being urged inwardly towards one another so as to apply a clamping force on the side wall of the container, thereby maintaining the device in supported position thereon.

In use, preferably four devices are attachable to the container, including a first pair on one side wall of the container and a second pair on an opposite side wall of the container, the devices in each pair being disposed in space relation to one another. In this manner, the arrangement of devices support the opposite handles of a plastic grocery bag, maintaining the bag open to facilitate placement of trash articles therein. Alternatively, a full size trash can liner can be used with the smaller plastic grocery bag supported therein for placement of select articles of trash, such as recyclables, thereby facilitating trash segregation within a single trash can.

It is therefore an object of the present invention to provide a device which is adapted to be removably attached to the side walls of virtually any conventionally-known trash container for supporting a plastic grocery bag therein.

It is also an object of the present invention to provide a bag support device which includes clamp means which is structured to clampingly engage opposite surfaces of a side wall of a trash container so as to facilitate removable attachment of a device thereto.

It is yet a further object of the present invention to provide a bag support device which is easily and removably attachable to virtually any commerciallyknown trash container and which is structured to support a handle of a plastic grocery bag within the container without interfering with various structure on the trash container, including a covering lid.

It is still a further object of the present invention to provide a bag support device which is adaptable for removable attachment to the side wall of a trash container, wherein several and preferably four of the devices are attachable on opposite side walls of the container so as to support opposite handles of a plastic grocery bag within the container, maintaining the plastic bag in an open, functional position to receive articles of trash therein.

These and other objects and advantages of the present invention will become more readily apparent to those skilled in the art when taken in connection with the accompanying description and drawings.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
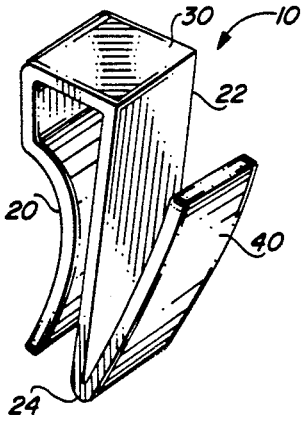
FIG. 1 is a perspective view of the bag support device of the present invention.
Figure 2:
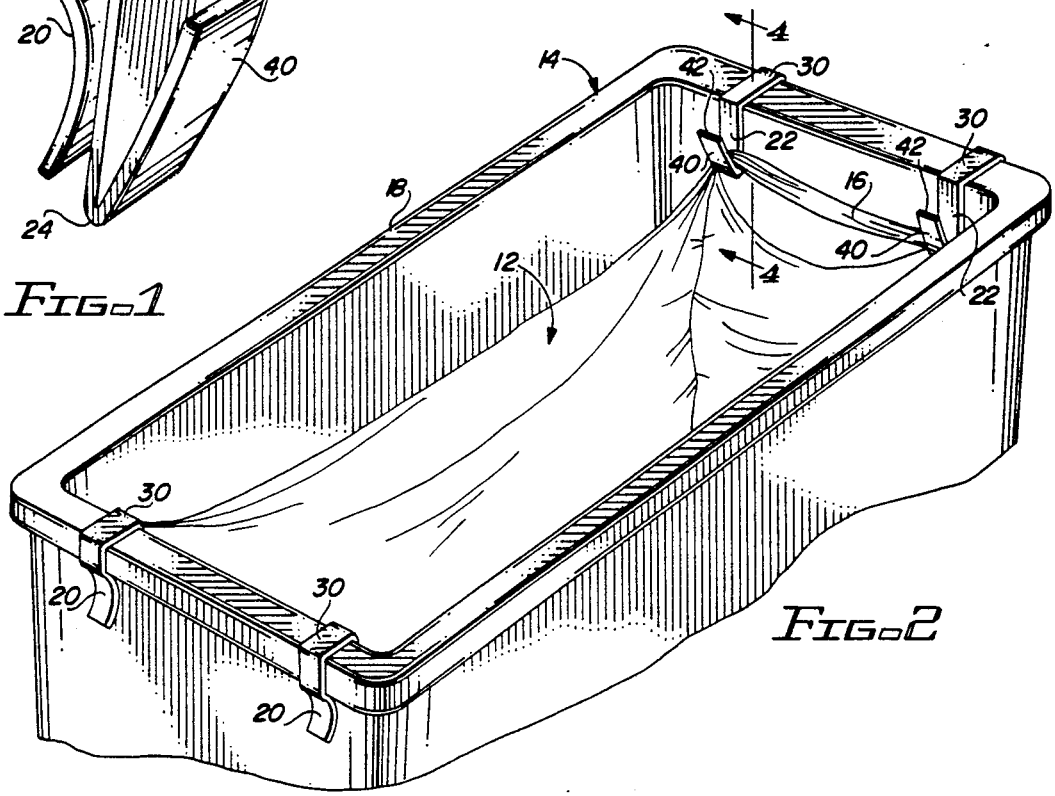
FIG. 2 is a perspective view illustrating attachment of four of the bag support devices of the present invention attached to the side walls of a trash container in a preferred orientation so as to support the handles of a plastic bag therein, maintaining the bag in an open, functional position.
Figure 3:
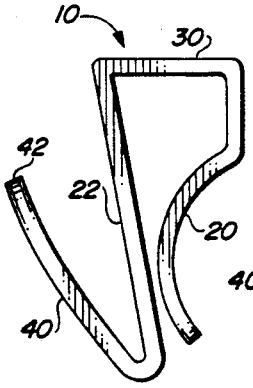
FIG. 3 is a side elevation of the bag support device.

Referring to the drawings, and initially FIGS. 1 and 2, the present invention is directed to a bag support device, generally indicated as 10, for supporting a bag 12 within a trash container 14, as best illustrated in FIG. 2. The plastic grocery bag 12 is provided with handles 16 which are supported by the device. As shown in FIG. 2, preferably four support devices are attached to the trash container 14, with one pair of the devices 10 on one side and another pair attached to an opposite side in space relation to one another so as to support the handle 16 such that the plastic bag 12 is held open so that various articles of trash can be deposited therein.

The bag support device 10 includes clamp means including a pair of substantially elongate clamp arms 20 and 22 structured to extend downwardly from a rim 18 of the trash container on opposite sides of a wall 19 of the container 14. The clamp arms 20, 22 are urged inwardly so as to converge near mid-sections thereof, so as to exert a clamping force on opposite sides of the wall 19 of a trash container 14, effectively maintaining the device 10 in attached position. A spacer element 30 is integrally formed with and extends between upper ends of the clamp arms 20, 22 to facilitate placement of the device over the rim 18 of the trash container 14.

Figure 4:
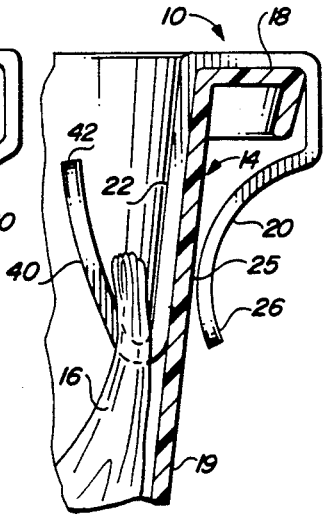
FIG. 4 is a sectional view taken along line 4—4 of FIG. 2.
Figure 5:
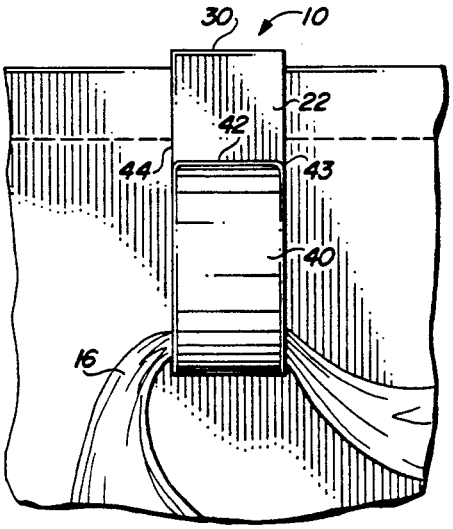
FIG. 5 is an end elevation view, shown in isolation, illustrating support of a bag handle on a hook member of the device of the present invention.

A hook member 40 extends upwardly from a lower end 24 of clamp arm 22, and is specifically structured and configured to support a portion of the handle 15 of the bag 12 thereon, as illustrated in FIGS. 2, 4 and 5.

Referring to FIG. 4, it is seen that the spacer element 30 separates the upper ends of the clamp arms 20, 22 a sufficient distance to allow the rim 1 of the trash container 14 to fit therebetween. In this manner, a variety of trash containers, having varying rim widths, can be accommodated. The clamp arm 20 is formed and configured so as to converge toward the clamp arm 22, and accordingly, the wall of the container 19 therebetween, such that a clamping force is provided as at 25 along side wall 19, thereby maintaining the device 10 in place. A lower distal end 26 of the clamp arm 20 curves outwardly away from the clamp point 25 thereby facilitating grasping of the distal end 26, enabling the clamp arms 20, 22 to be pried apart for passage of the device over the rim 18 of the container 14.

As best seen in FIG. 4, the spacer element 30 preferably extends along the top surface of the rim 18 in a manner so as to minimize interference with other structure of the container 14, including a covering lid to be fitted over the rim 18.

The hook member 40 curves upwardly from the lower end 24 of clamp arm 22 in close, space relation thereto terminating at a free distal end 42, defining a mouth for passage of the bag handle 16 therethrough. As seen in FIG. 5, the corners of the free distal end 42 of hook member 40 are preferably rounded, as at 43 and 44, thereby eliminating any sharp edges or points which might cut the handle 16 of the plastic bag or cause injury.

While this invention has been described in its preferred embodiment, it is to appreciated that variations therefrom may be made without departing from the spirit of the invention, and the scope of the invention is not to be limited except as set forth in the claims and within the doctrine or equivalents.

Now that the invention has been described,

What is claimed is:

1. A bag supporting system for use in supporting a plastic bag within a trash container, having surrounding side walls and an open mouth with a rim bordering the open mouth, and wherein the plastic bag includes a body having an open end and at least two handles on opposite sides thereof to facilitate carrying of the bag, said support system comprising:

a plurality of support devices, each being structured for removable attachment to one of the surrounding side walls of the trash container, at least two of said support devices being attached on opposite side walls of the trash container, each of said clamp devices including clamp means for removably attaching said device to one of the side walls of the trash container, said clamp means including a pair of clamp arms including a first arm and a second arm, said clamp arms being structured and disposed to extend downwardly on opposite sides of the side wall of the trash container, at least one of said arms being urged inwardly toward the other arm defining a clamping position, wherein a clamping force is exerted on the side wall so as to maintain the device in attached relation thereto, said clamp arms including a memory causing said clamp arms to return to said clamping position upon removing an external prying force therefrom, each of said support devices further including a spacer element integrally formed with and extending between upper ends of said clamp arms so as to separate said upper ends of said clamp arms a sufficient distance to accommodate positioning of the rim of the container therebetween, a lower distal end portion of said first arm being structured to curve outwardly away from said second arm and the side wall, said curved lower distal end portion of said first arm being sufficiently spaced from said upper end thereof and said spacer element such that said lower distal end portion is disposed substantially below the rim of the container when in said clamping position around the side wall of the trash container, thereby minimizing the potential for slippage, a hook member extending upwardly from a lower end of said second arm on each of said support devices within said trash container and being structured and disposed to support at least a portion of one of the handles of the bag thereon, and wherein the opposite handles of the plastic bag are supported by the support devices in such a manner so as to maintain the plastic bag in an open position, thereby facilitating various articles of trash to be deposited into the plastic bag through the open end thereof.

* * * * *